US007503755B2

(12) United States Patent
Lai et al.

(10) Patent No.: US 7,503,755 B2
(45) Date of Patent: Mar. 17, 2009

(54) BAFFLE PLATE ASSEMBLY FOR A COMPRESSOR

(75) Inventors: Ching-Feng Lai, Taichung (TW); Yu-Choung Chang, Hsinchu Hsien (TW); Kun-I Liang, Hsinchu Hsien (TW); Ann Huang, Hsinchu (TW)

(73) Assignee: Industrial Technology Research Institute, Hsinchu Hsien (TW)

( * ) Notice: Subject to any disclaimer, the term of this patent is extended or adjusted under 35 U.S.C. 154(b) by 940 days.

(21) Appl. No.: 10/790,346

(22) Filed: Mar. 1, 2004

(65) Prior Publication Data

US 2004/0166008 A1 Aug. 26, 2004

Related U.S. Application Data

(62) Division of application No. 10/334,253, filed on Dec. 30, 2002, now abandoned.

(51) Int. Cl.
*F01C 1/02* (2006.01)

(52) U.S. Cl. ..... 417/292; 417/298; 417/313

(58) Field of Classification Search ..... 418/180, 418/83, 181; 417/292, 295, 298, 441, 312, 417/313

See application file for complete search history.

(56) References Cited

U.S. PATENT DOCUMENTS

| | | | | |
|---|---|---|---|---|
| 3,270,952 A | | 9/1966 | Bellmer | 230/58 |
| 4,627,861 A | | 12/1986 | Ibaraki et al. | 96/393 |
| 4,767,293 A | * | 8/1988 | Caillat et al. | 418/55.3 |
| 5,055,010 A | | 10/1991 | Logan | 417/410.5 |
| 5,240,391 A | | 8/1993 | Ramshankar et al. | 417/410.1 |
| 6,402,485 B2 | | 6/2002 | Hong et al. | 417/366 |
| 6,474,964 B2 | | 11/2002 | De Bernardi et al. | 418/55.6 |

FOREIGN PATENT DOCUMENTS

| | | | |
|---|---|---|---|
| DE | 1503656 A1 | | 11/1969 |
| EP | 1787567 A2 | * | 5/2007 |

* cited by examiner

*Primary Examiner*—William H. Rodriguez
*Assistant Examiner*—Vikansha Dwivedi
(74) *Attorney, Agent, or Firm*—Schwegman, Lundberg & Woessner P.A.

(57) ABSTRACT

A baffle plate assembly has a baffle plate comprising a back plate and a partition wall. The back plate has an inner space and is attached to the housing of the compressor. The partition wall is formed on the back plate to divide the inner space of the back plate into at least one upper guiding channel communicating with the compressing chamber in the compressor and at least one lower guiding channel communicating with the motor chamber of the compressor. Accordingly, the working fluid can be respectively led into the compressing chamber and the motor chamber of the compressor through the at least one upper guiding channel and the at least one lower guiding channel in a certain proportion. Consequently, the compressor will operate at an optimal condition.

15 Claims, 10 Drawing Sheets

BAFFLE PLATE ASSEMBLY FOR A COMPRESSOR

The application is a divisional application of an U.S. application with Ser. No. 10/334,253, filed on Dec. 30, 2002 now abandoned, which is hereby incorporated by reference.

BACKGROUND OF THE INVENTION

1. Field of the Invention

The present invention relates to a baffle plate assembly, and more particularly to a baffle plate assembly for a compressor to guide the working fluid respectively into the compressing chamber and the motor chamber of the compressor in a certain proportion.

2. Description of Related Art

To reduce the temperature in a compressor, part of a working fluid will be led into the motor chamber of the compressor to reduce the temperature of the motor. For example, U.S. Pat. No. 3,270,952 entitled "Protective Device For Compressors" to Bellmer shows a baffle plate mounted in a compressor and corresponding to the compressor inlet. Accordingly, the working fluid entering the compressor from the inlet will contact the baffle plate. Part of the working fluid will be led into the motor unit chamber to reduce the temperature of the motor, and the remaining working fluid will be led into the compressor unit chamber for the compressing process.

However, the baffle plate of Bellmer is a curved plate secured in the compressor, and the proportion of the working fluid flowing into the motor unit chamber and the compressor unit chamber is not certain. The compressor cannot work at an optimal condition due to the uncertain proportion of the working fluid used in this way. In addition, the working fluid entering from the inlet will impact the baffle plate of Bellmer directly at a high speed so as to make an undesirable noise.

To overcome the shortcomings, the present invention tends to provide a baffle plate assembly to mitigate or obviate the aforementioned problems.

SUMMARY OF THE INVENTION

The main objective of the invention is to provide a baffle plate assembly for a compressor and that can lead the working fluid respectively into the compressing chamber and the motor chamber of the compressor in a certain proportion. The baffle plate assembly has a baffle plate comprising a back plate and a partition wall. The back plate has an inner space and is attached to the housing of the compressor. The partition wall is formed on the back plate to divide the inner space of the back plate into at least one upper guiding channel communicating with the compressing chamber in the compressor and at least one lower guiding channel communicating with the motor chamber of the compressor. Accordingly, the working fluid can be respectively led into the compressing chamber and the motor chamber of the compressor through the at least one upper guiding channel and the at least one lower guiding channel. Consequently, the compressor will operate at an optimal condition.

Other objects, advantages and novel features of the invention will become more apparent from the following detailed description when taken in conjunction with the accompanying drawings.

DETAILED DESCRIPTION OF PREFERRED EMBODIMENT

Figure 1:
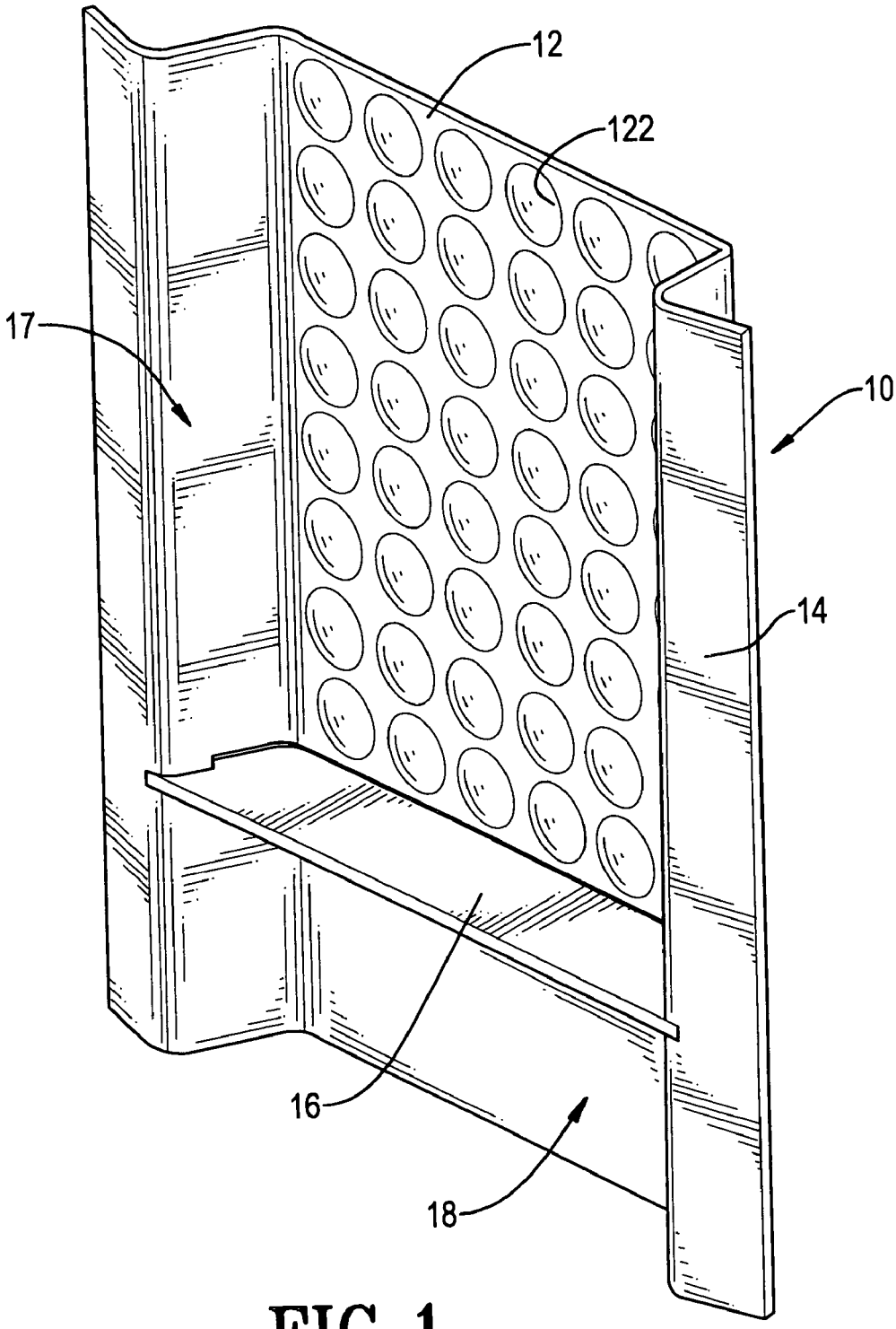
FIG. 1 is a perspective view of a first embodiment of a baffle plate assembly in accordance with the present invention.
Figure 2:
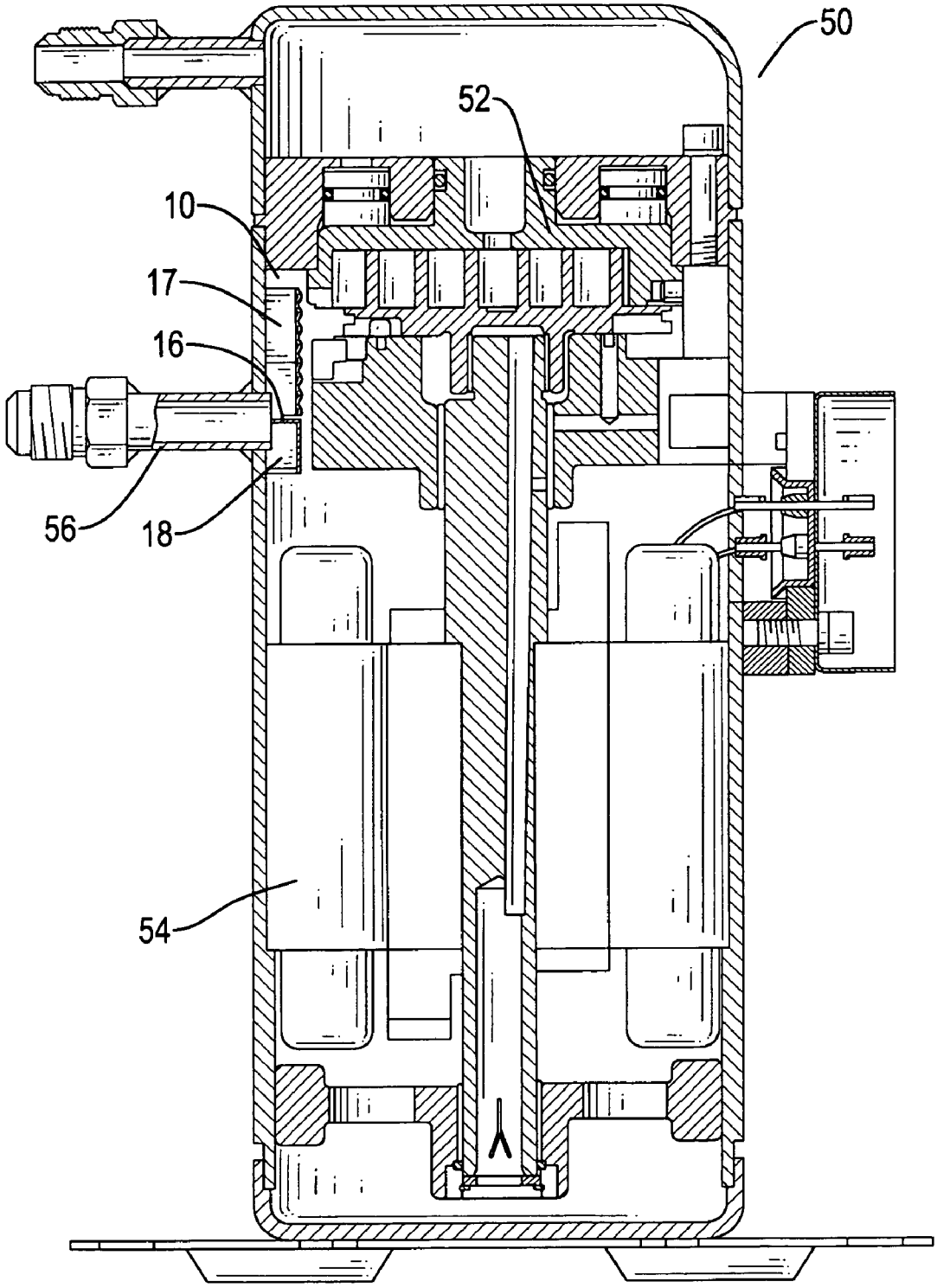
FIG. 2 is a side plan view in partial cross section of a compressor with a baffle plate assembly in FIG. 1.

With reference to FIGS. 1 and 2, a baffle plate assembly for a compressor in accordance with the present invention comprises a baffle plate (10). The baffle plate (10) is attached to the housing of the compressor (50) at a position corresponding to the inlet (56) of the compressor (50). The baffle plate (10) has a back plate (12) and a partition wall (16). The back plate (10) has a U-shaped cross section to define an inner space in the back plate (10). Two wings (14) respectively extend from two sides of the back plate (10).

The partition wall (16) is formed on the back plate (12) to divide the inner space of the back plate (12) into at least one upper guiding channel (17) and at least one lower guiding channel (18). In a first embodiment, the partition wall (16) is laterally formed between the wings (14) to divide the inner space into one upper guiding channel (17) above the partition wall (16) and one lower guiding channel (18) below the partition wall (16). Multiple recesses (122) are defined in the back plate (12) at a position corresponding to the upper guiding channel (17).

In another embodiment, the partition wall has a T shape to define one upper guiding channel (17) and two lower guiding channels (18) in the back plate (12), or the partition wall has an inverse T shape to define two upper guiding channels (17) and one lower guiding channel (18) in the back plate (12).

With reference to FIGS. 1 and 2, the baffle plate (10) is securely attached to the housing of the compressor (50) at a position where the partition wall (16) faces the inlet (56) of the compressor (50). The inlet (56) simultaneously communicates with the upper guiding channel (17) and the lower guiding channel (18). In practice, screws (not shown) penetrate through the wings (14) on the back plate (12) and are screwed into the housing, such that the baffle plate (10) is securely attached to the housing with the screws. In another embodiment, the baffle plate is secured to the housing with a welding process. Accordingly, the upper guiding channel (17) and the lower guiding channel (18) simultaneously communicate with the inlet (56) and respectively communicate with the compressing chamber (52) and the motor chamber (54) in the compressor (50).

When the working fluid enters the housing from the inlet (56), the entering fluid will be divided and respectively led into compressing chamber (52) and the motor chamber (54) respectively through the upper guiding channel (17) and the lower guiding channel (18). The proportion of the fluid entering the compressing chamber (52) and the motor chamber (54) is determined by the position where the partition wall (16) locates and is certain. The motor in the motor chamber (54) can be efficiently cooled by the working fluid entering into the motor chamber (54) in a certain proportion. The remaining working fluid entering into the compressing chamber (52) will also provide an excellent work effect for a refrigerating cycle or an air condition cycle. Therefore, the operation of the compressor (50) can be controlled under an optimal condition. In addition, the proportion of the fluid entering the compressing chamber (52) and the motor chamber (54) is adjustable by means of changing the location of the partition wall (16).

Additionally, the partition wall (16) can enhance the stiffness of the baffle plate (10) so as to reduce the noise when the working fluid impacts the baffle plate (10).

Furthermore, the recesses (122) in the back plate (12) can increase the area of the back plate (12) for the oil in the working fluid adhering to the back plate (12) when the working fluid passes through the upper guiding channel (17). This can keep the working fluid entering the compressing chamber (52) from containing too much oil, and the refrigerating effect provided by the working fluid is improved.

Figure 3:
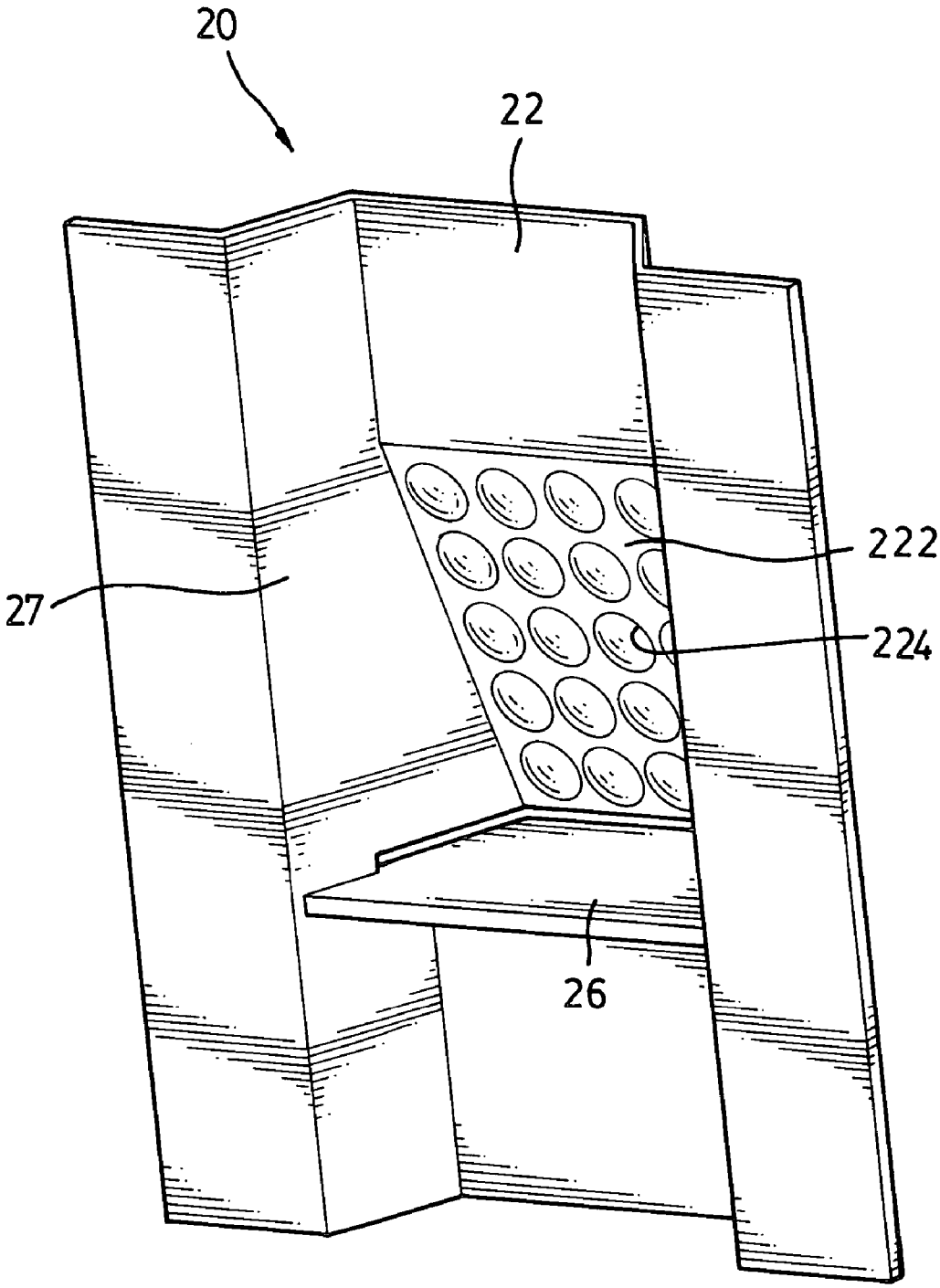
FIG. 3 is a perspective view of a second embodiment of a baffle plate assembly in accordance with the present invention.
Figure 4:
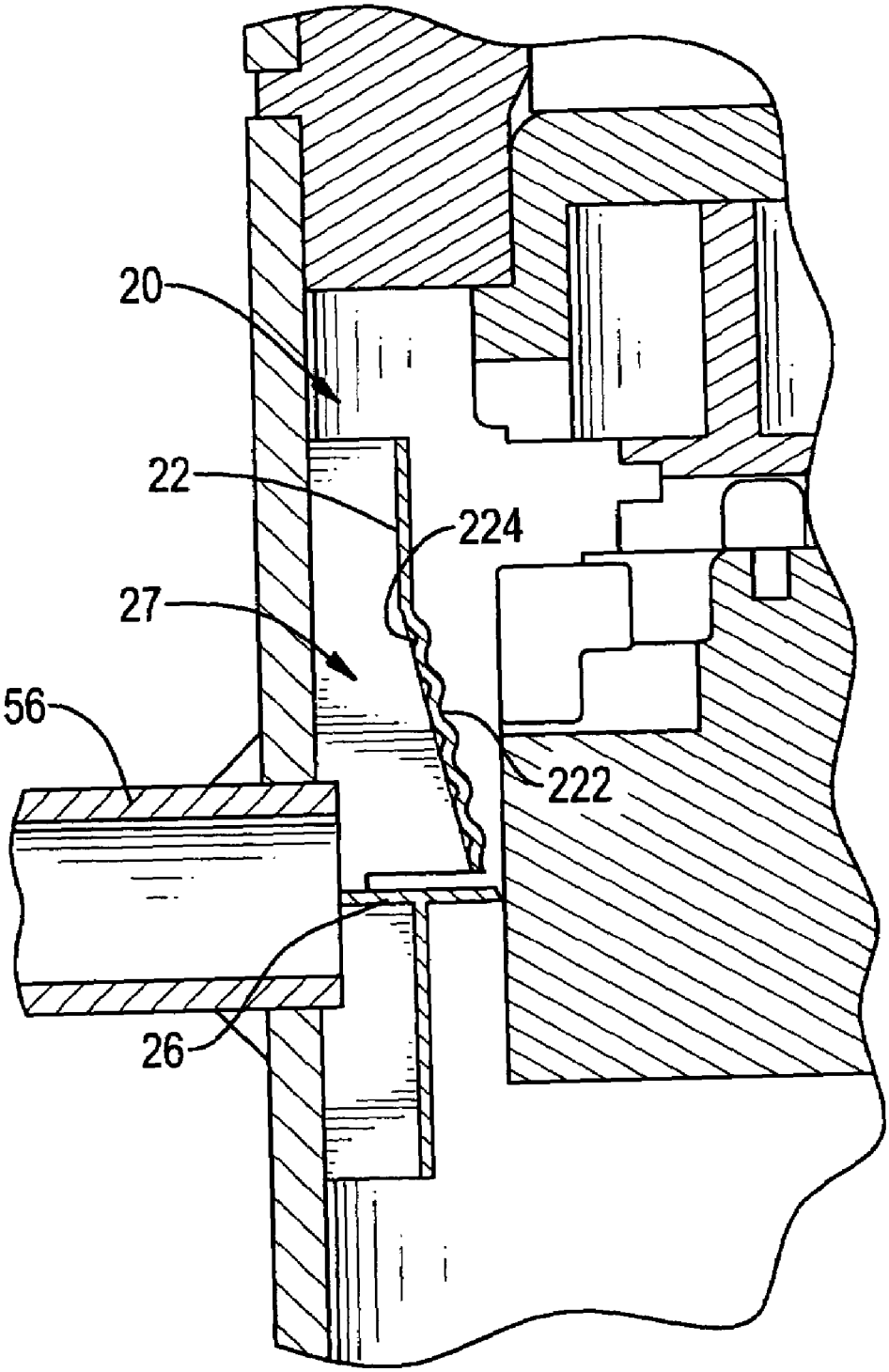
FIG. 4 is an enlarged cross sectional side plan view of part of a compressor with the baffle plate assembly in FIG. 3.
Figure 5:
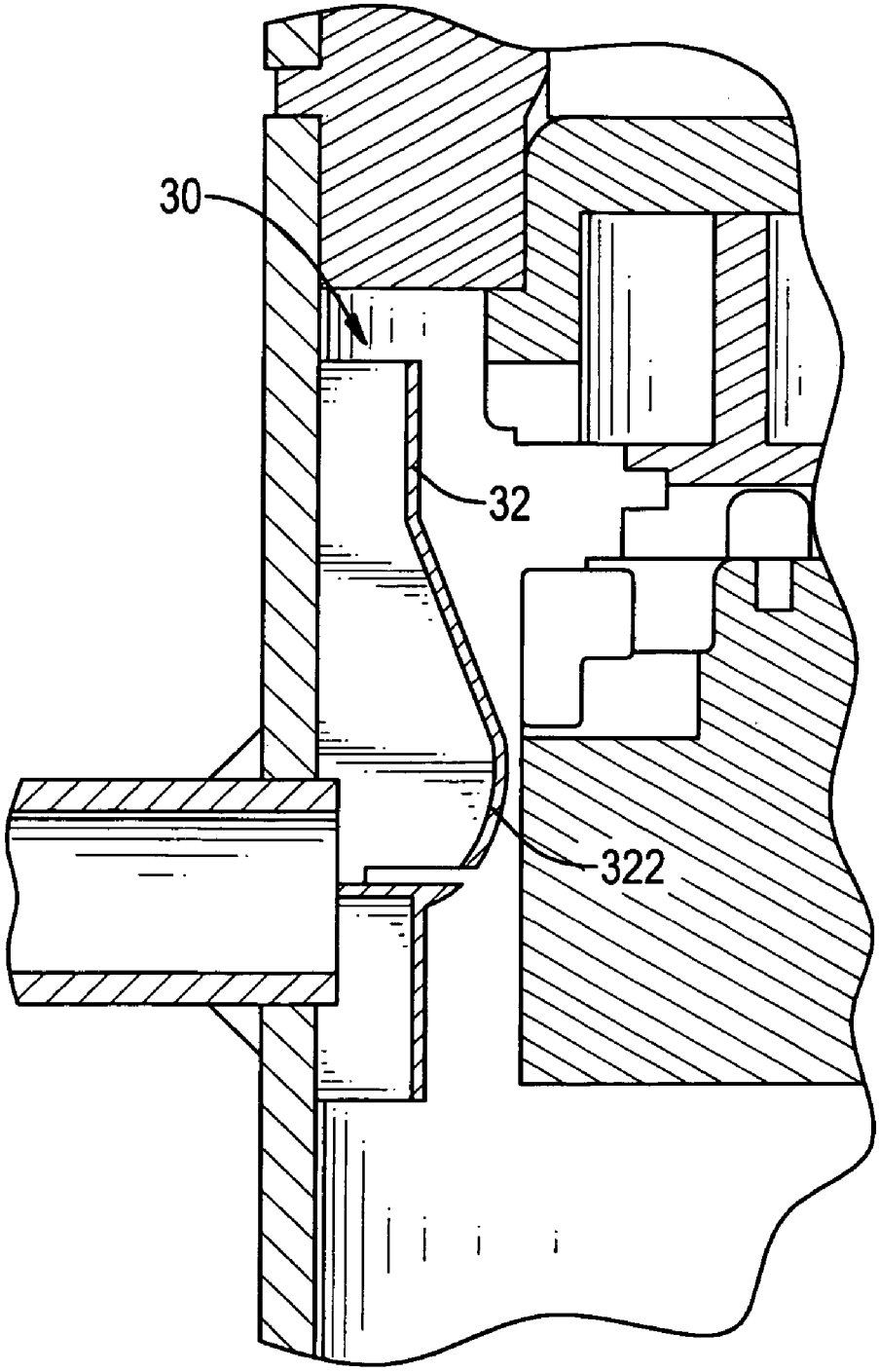
FIG. 5 is an enlarged cross sectional side plan view of part of a compressor with a third embodiment of a baffle plate assembly in accordance with the present invention.

With reference to FIGS. 3 and 4, in a second embodiment, a cavity (222) is defined in the back plate (22) at a position corresponding to the upper guiding channel (27) and above the lateral partition wall (26). Multiple recesses (224) are defined in the back plate (22) at a position corresponding to the cavity (222). With the arrangement of the cavity (222), the baffle plate (20) can fit with a compressor with a different structure, and the use of the baffle plate assembly is versatile. In an embodiment, the area on the back plate (22) corresponding to the cavity (222) has an inclined section. In another embodiment, with reference to FIG. 5, the area on the back plate (32) of the baffle plate (30) corresponding to the cavity (322) has a curved cross section.

Figure 6:
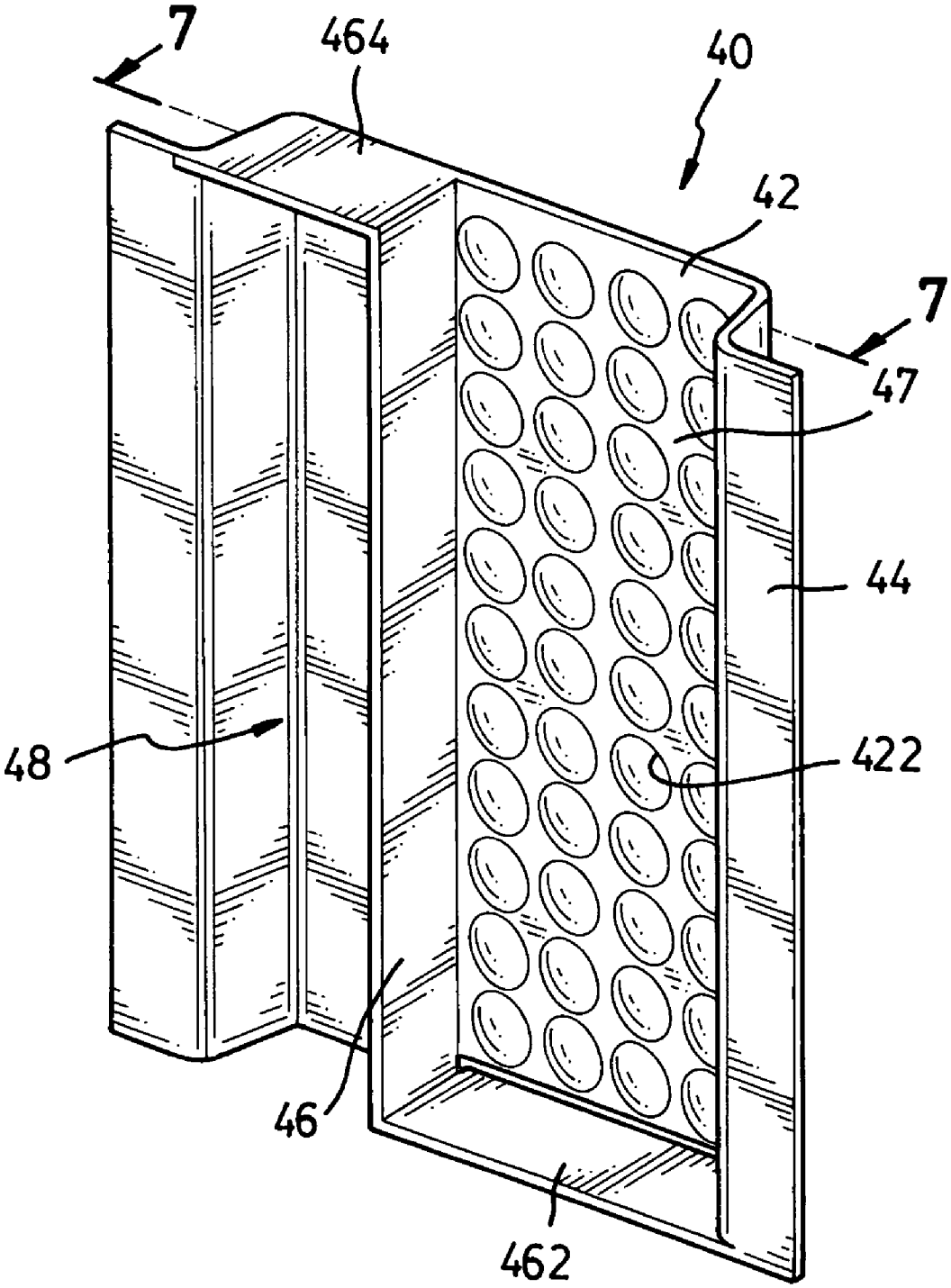
FIG. 6 is a perspective view of a fourth embodiment of a baffle plate assembly in accordance with the present invention.
Figure 7:
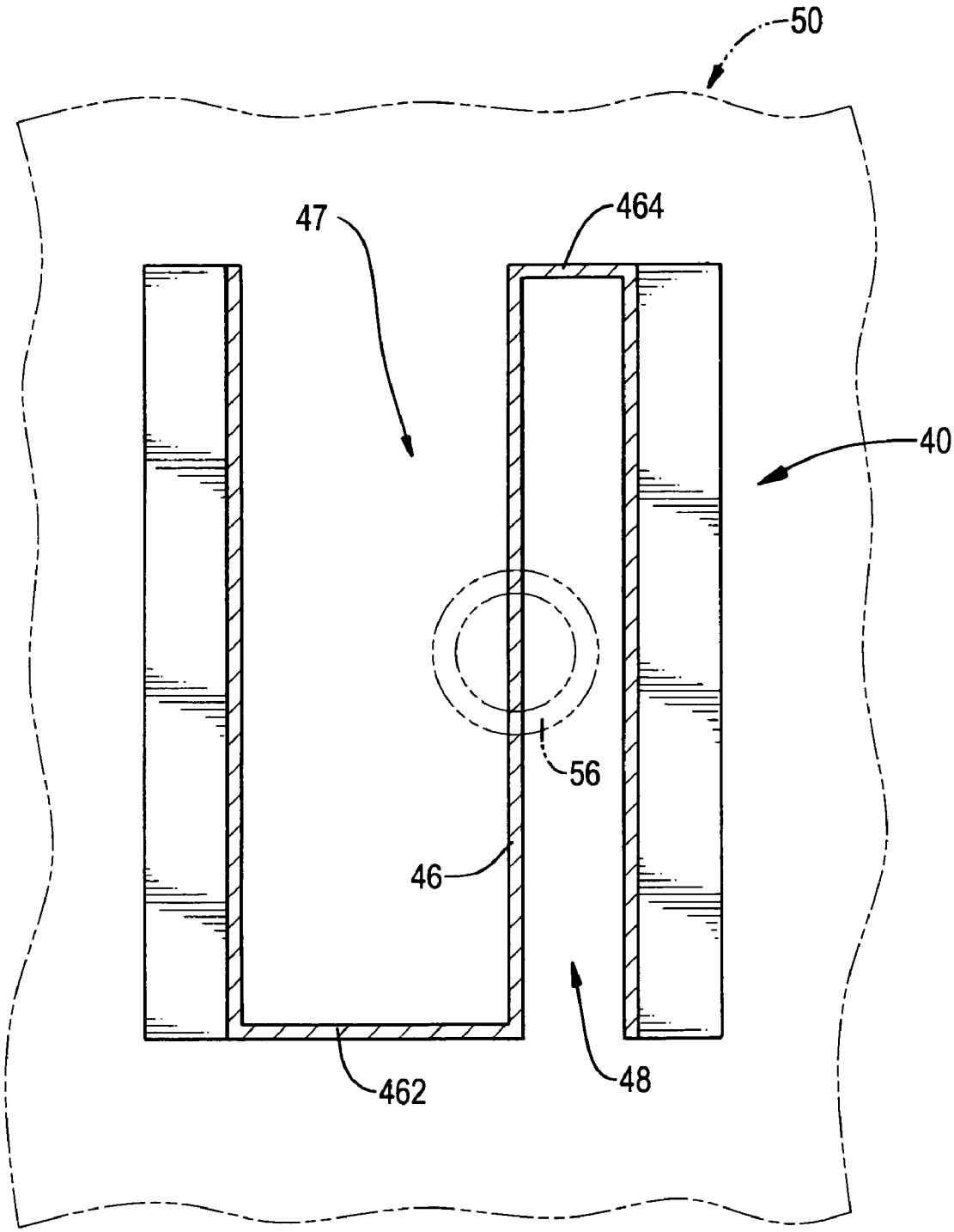
FIG. 7 is a cross section side plan view of the baffle plate assembly in FIG. 6 with a compressor showing the structural relationship between the baffle plate assembly and the inlet of the compressor.

With reference to FIGS. 6 and 7, the partition wall (46) is longitudinally formed on the back plate (42) to divide the inner space into one upper guiding channel (47) and one lower guiding channel (48) respectively at two sides of the partition wall (46). A lower closed wall (462) extends from the bottom end of the partition wall (46) and is connected to the wing (44) corresponding to the upper guiding channel (47) to make an upper opening (not numbered) in the upper guiding channel (47). An upper closed wall (464) extends from the top end of the partition wall (46) and is connected to the other wing (44) corresponding to the lower guiding channel (48) to make a lower opening (not numbered) in the lower guiding channel (48).

Accordingly, the working fluid entering from the inlet (56) of the compressor will be led into the upper guiding channel (47) and the lower guiding channel (48) in a certain proportion and will be respectively discharged from the upper opening and the lower opening. In addition, multiple recesses (422) are defined in the back plate (42) of the baffle plate (40) at a position corresponding to the upper guiding channel (47) for the oil in the working fluid to adhere to the back plate (42).

Figure 8:
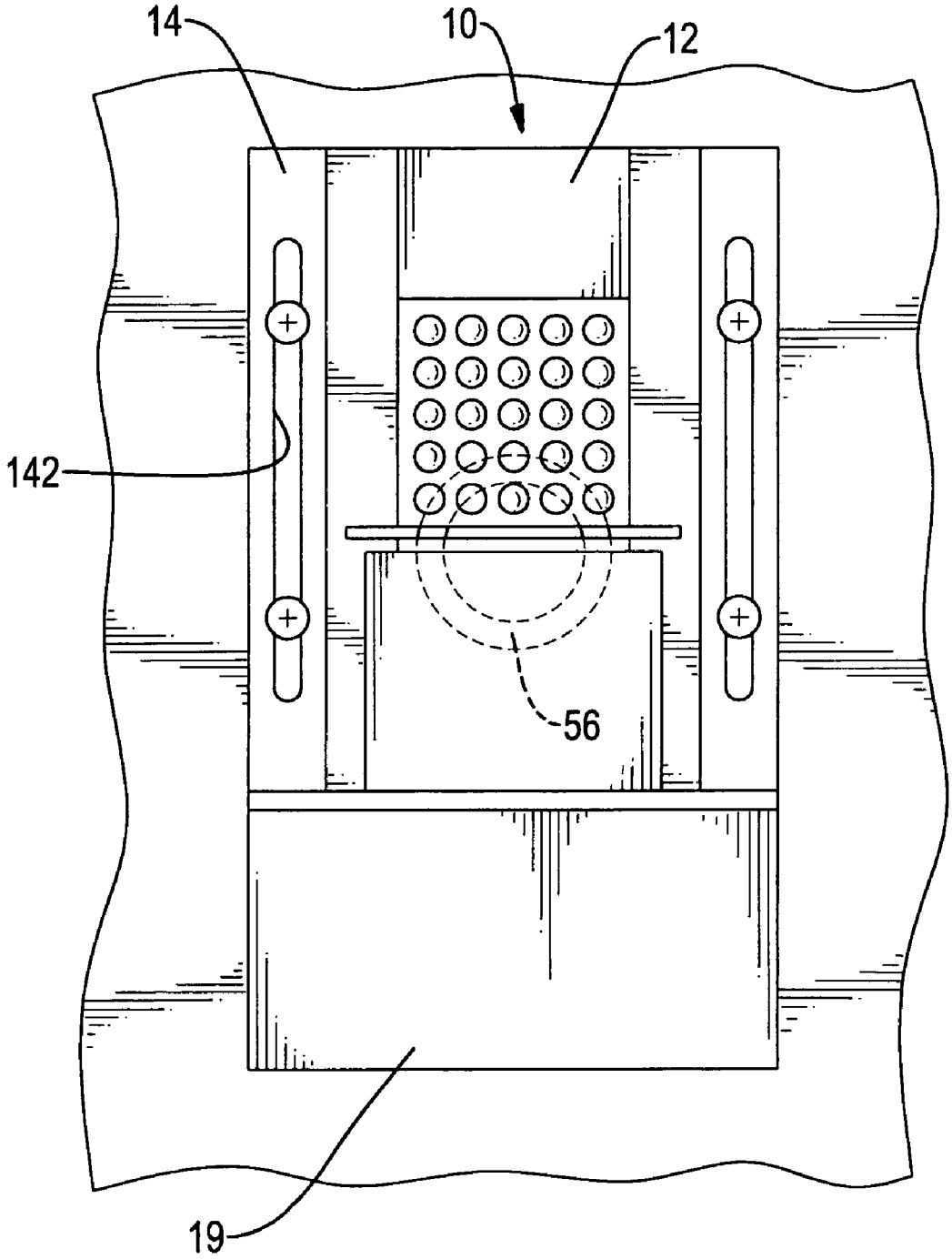
FIG. 8 is a side plan view of part of a compressor with a fifth embodiment of a baffle plate assembly in accordance with the present invention.
Figure 9:
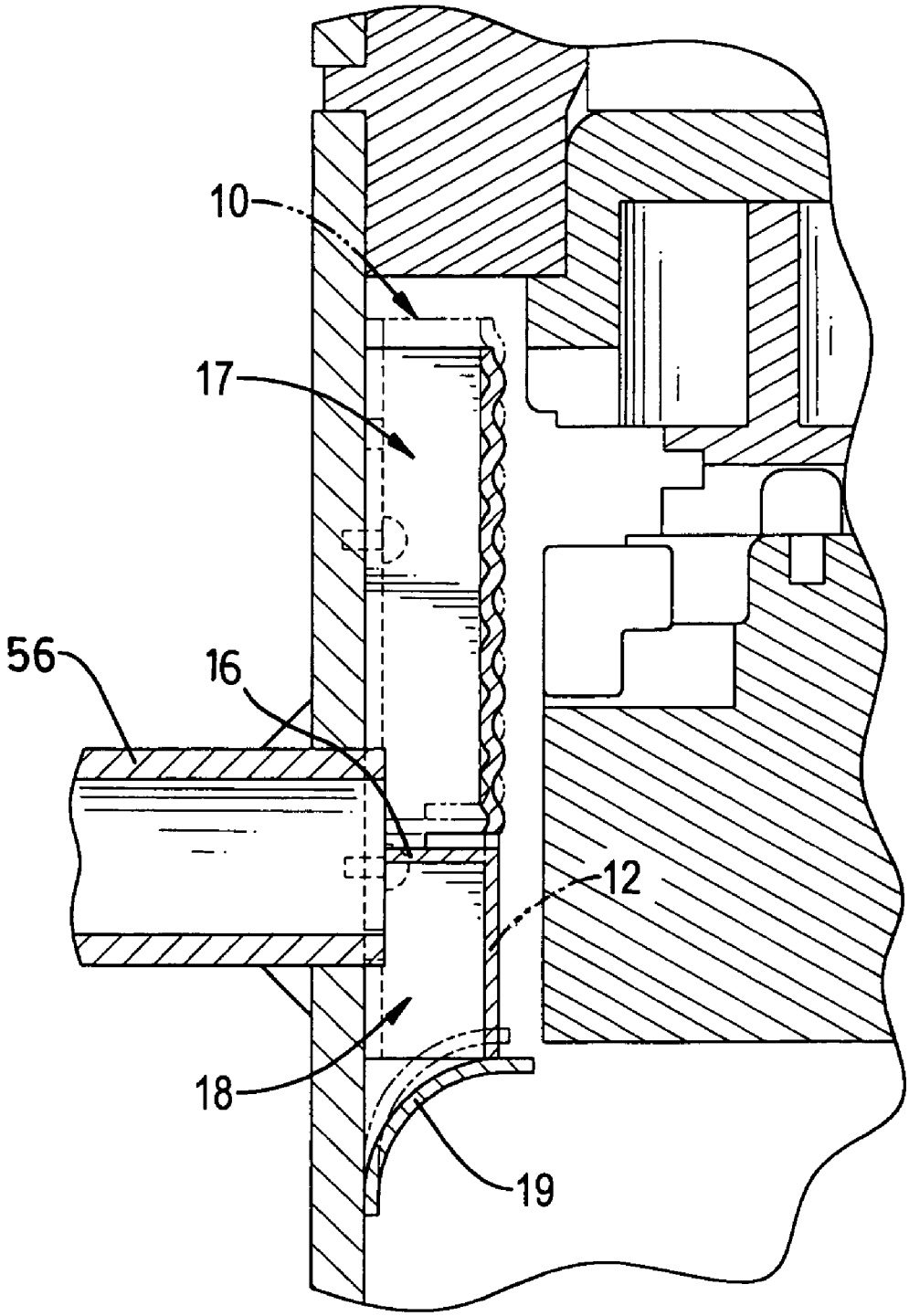
FIG. 9 is a cross sectional side plan view of the compressor with the baffle plate assembly in FIG. 8.

With reference to FIGS. 8 and 9, and in reference to FIG. 2, the baffle plate assembly further comprises a thermal-conductive element (19). The thermal conductive element (19) is attached to the bottom of the back plate (12) and is securely attached to the housing of the compressor (50). In practice, the thermal conductive element (19) comprises two metal plates combined with each other and each having a thermal expansion coefficient different from that of the other. The thermal conductive element will deform when the temperature in the motor chamber (54) changes.

Figure 10:
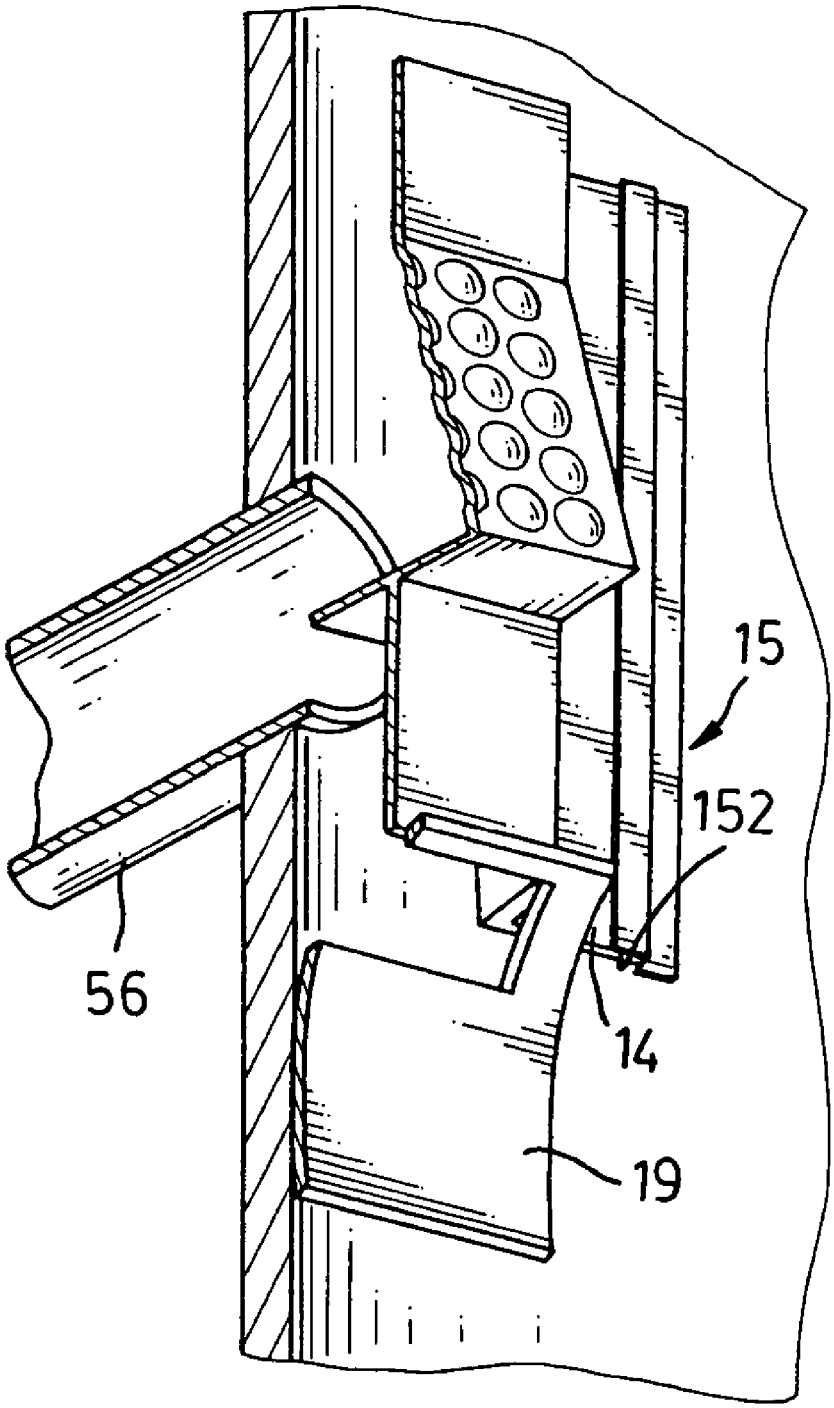
FIG. 10 is a perspective view in partial cross section of part of a compressor with a sixth embodiment of a baffle plate assembly in accordance with the present invention.

The baffle plate (10) is moveably attached to the housing of the compressor (50) and is attached to the thermal conductive element (19). A sliding device is mounted on the baffle plate (10) to make the baffle plate (10) be moveably attached to the housing of the compressor (50). In practice, the sliding device comprises two longitudinal grooves (142) respectively defined through the wings (14) and screws (not numbered) penetrating through the grooves (142). The screws penetrating through the grooves (142) are screwed into the housing of the compressor (50), such that the baffle plate (10) is moveably attached to the housing with the screws. In another embodiment, with reference to FIG. 10, the sliding device comprises two rails (15) each with a channel (152) respectively receiving the wings (14) in the channels (152), and the rails (15) are attached the housing. Consequently, the baffle plate (10) can move relative to the housing along the rails (15).

When the temperature in the motor chamber (54) rises, the thermal conductive element (19) deforms to push the baffle plate (10) to move upward. Accordingly, the area of the inlet (54) communicating with the lower guiding channel (18) is increased, such that the amount of the working fluid flowing into the motor chamber (54) will increase. This can provide an enhanced cooling effect to the motor in the motor chamber (54), and the temperature in the motor chamber (54) can be rapidly reduced.

When the temperature in the motor chamber (54) is reduced, the thermal conductive element (19) will deform to pull the baffle plate (10) to move downward. This can reduce the area in the inlet (56) communicating with the lower guiding channel (18), and the amount of the working fluid flowing into the motor chamber (54) is decreased. Accordingly, the temperature in the motor chamber (54) can be automatically controlled at a desired range by means of the movement of the baffle plate (10) actuated by the thermal conductive element (19). Consequently, the operation of the compressor (50) is efficient and is improved.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A baffle plate assembly for a compressor having a housing, a compressing chamber, a motor chamber and an inlet, the baffle plate assembly comprising:

a baffle plate adapted to be attached to the housing of the compressor, adapted to correspond to the inlet of the compressor and having:

a back plate with a bottom and an inner space and adapted to be attached to the housing of the compressor;

a partition wall formed on the back plate to divide the inner space of the back plate into at least one upper guiding channel adapted to communicate with the compressing chamber in the compressor and at least one lower guiding channel adapted to communicate with the motor chamber of the compressor; and a thermal-conductive element attached to the bottom of the back plate and adapted to securely attached to the housing of the compressor to make the back plate be moveably attached to the housing of the compressor.

2. The baffle plate assembly as claimed in claim 1, wherein the back plate has a U-shaped cross section to define an inner space in the back plate.

3. The baffle plate assembly as claimed in claim 2, wherein the back plate has two wings respectively extending from two sides of the back plate.

4. The baffle plate assembly as claimed in claim 3, wherein the partition wall is laterally formed between the wings to divide the inner space into one upper guiding channel and one lower guiding channel.

5. The baffle plate assembly as claimed in claim 3, wherein multiple recesses are defined in the back plate at a position corresponding to the at least one upper guiding channel.

6. The baffle plate assembly as claimed in claim 2, wherein multiple recesses are defined in the back plate at a position corresponding to the at least one upper guiding channel.

7. The baffle plate assembly as claimed in claim 2, wherein the back plate has a cavity defined in the back plate at a position corresponding to the at least one upper guiding channel.

8. The baffle plate assembly as claimed in claim 7, wherein multiple recesses are defined in the back plate at a position corresponding to the cavity.

9. The baffle plate assembly as claimed in claim 8, wherein the back plate has an inclined section at an area where corresponds to the cavity.

10. The baffle plate assembly as claimed in claim 1, wherein multiple recesses are defined in the back plate at a position corresponding to the at least one upper guiding channel.

11. The baffle plate assembly as claimed in claim 1, wherein the thermal conductive element comprises two metal plates combined with each other and each having a thermal expansion coefficient different from that of the other.

12. The baffle plate assembly as claimed in claim 7 further comprising a sliding device mounted on the back plate to make the back plate be moveably attached to the housing of the compressor.

13. The baffle plate assembly as claimed in claim 12, wherein the sliding device comprises:

two wings respectively formed on two sides of the back plate;

a longitudinal groove defined through each respective wing; and at least one screw penetrating through each respective longitudinal groove and adapted to be screwed into the housing of the compressor.

14. The baffle plate assembly as claimed in claim 13, wherein multiple recesses are defined in the back plate at a position corresponding to the at least one upper guiding channel.

15. The baffle plate assembly as claimed in claim 12, wherein multiple recesses are defined in the back plate at a position corresponding to the at least one upper guiding channel.

* * * * *